US007806716B2

(12) United States Patent
Zahlmann et al.

(10) Patent No.: US 7,806,716 B2
(45) Date of Patent: Oct. 5, 2010

(54) PLUG-IN COMBINATION OF APPLIANCES FOR PROTECTING AGAINST OVERVOLTAGES

(75) Inventors: Peter Zahlmann, Neumarkt (DE); Ralph Brocke, Ilmenau (DE); Edmund Zäuner, Berching/Pollanten (DE); Martin Strobl, Neumarkt (DE); Michael Waffler, Neumarkt (DE); Sascha Ludewig, Neumarkt (DE); Georg Wittmann, Lauterhofen (DE); Stephan Hierl, Neumarkt (DE); Florian Gaeck, Freystadt (DE); Bernhard Krauss, Berg (DE); Jens Ehrler, Neumarkt (DE)

(73) Assignee: DEHN + SOHNE GmbH & Co. KG, Neumarkt/Opf. (DE)

( * ) Notice: Subject to any disclaimer, the term of this patent is extended or adjusted under 35 U.S.C. 154(b) by 108 days.

(21) Appl. No.: 11/883,869

(22) PCT Filed: Jan. 3, 2006

(86) PCT No.: PCT/EP2006/000018

§ 371 (c)(1),
(2), (4) Date: Jun. 4, 2008

(87) PCT Pub. No.: WO2006/084529

PCT Pub. Date: Aug. 17, 2006

(65) Prior Publication Data

US 2008/0254655 A1 Oct. 16, 2008

(30) Foreign Application Priority Data

Feb. 9, 2005 (DE) ..... 10 2005 005 914

(51) Int. Cl.
*H01R 13/627* (2006.01)

(52) U.S. Cl. ..... 439/354; 439/358

(58) Field of Classification Search ..... 439/353, 439/354, 357, 358

See application file for complete search history.

(56) References Cited

U.S. PATENT DOCUMENTS 6,033,252 A * 3/2000 Hood et al. ..... 439/374
6,196,858 B1 * 3/2001 Matsumoto et al. ..... 439/354
6,332,800 B2 * 12/2001 Kodama ..... 439/357

(Continued)

FOREIGN PATENT DOCUMENTS

DE 1036356 8/1958

(Continued)

*Primary Examiner*—Thanh-Tam T Le
(74) *Attorney, Agent, or Firm*—Gerald T. Bodner

(57) ABSTRACT

The invention relates to a plug-in combination of appliances for protecting against overvoltages, said combination of appliances comprising: a socket-type lower part and at least one plug-in module, which can both receive overvoltage protection elements; contact elements and contact counter elements that are respectively arranged in the lower part and in the plug-in module; and complementary guide rails or guide grooves for inserting or pushing-on and fixing the respective plug-in module. According to the invention, functionally separated, mechanical catch or snap-in elements act between the respective plug-in module and the socket-type lower part independently of the forces which hold together the contact elements and the contact counter elements in a positively fixed and/or non-positively fixed manner when the plug-in module is in use. The catch or snap-in function can be cancelled without any mechanical auxiliary means when the respective plug-in module is to be replaced.

19 Claims, 3 Drawing Sheets

U.S. PATENT DOCUMENTS

| | | | | |
|---|---|---|---|---|
| 7,431,605 | B2 * | 10/2008 | Dieterle et al. | 439/358 |
| 7,597,578 | B2 * | 10/2009 | Adunka et al. | 439/357 |
| 2005/0231872 | A1 | 10/2005 | Schimanski et al. | 361/91.1 |

FOREIGN PATENT DOCUMENTS

| | | |
|---|---|---|
| DE | 3639533 | 6/1988 |
| DE | 29519313 | 1/1996 |
| DE | 10001667 | 10/2001 |
| DE | 202004006227 | 9/2004 |
| EP | 1156558 | 11/2001 |
| WO | WO9512905 | 5/1995 |

* cited by examiner

PLUG-IN COMBINATION OF APPLIANCES FOR PROTECTING AGAINST OVERVOLTAGES

BACKGROUND OF THE INVENTION

1. Field of the Invention

The invention relates to a plug-in combination of appliances for protection against overvoltages, comprising a socket-type lower part and one or several plug-in modules which accommodate the overvoltage protection elements, contact elements and contact counter elements which are respectively arranged in the lower part and in the plug-in module, as well as complementary guide rails or guide grooves for the controlled insertion or sliding-on and fixing of the respective plug-in module in accordance with the preamble of Claim 1.

2. Description of the Related Art

In many cases, overvoltage protection devices according to the state of the art are constructed as plug-in combination of appliances, comprising a lower part and a plug-in module.

Connecting terminals for contact-making of the electric conductors are disposed in the lower part, and corresponding receptacles for the plug-in modules to be inserted are provided therein. The lower part also houses elements which encompass one or several male contacts of the plug-in module, so that the desired mechanical and electrical contact as well as the appropriate seat of the plug-in module in the lower part is ensured.

The overvoltage protection elements proper, such as e.g. spark gaps, varistors, gas dischargers, or the like are located within the plug-in module.

The lower parts are often formed as U-shaped bodies, with the open legs of the U-shaped body laterally encompassing the plug-in module so that the plug-in module rests upon the connecting leg of the U-shaped parts. The lower part is further provided with receptacle elements at its installation side, which enable a so-called top-hat rail assembly.

The advantage of the briefly described separated functions between lower part and plug-in module is that the plug-in module may be removed for inspection and maintenance work without the necessity to open the connecting terminal or to disconnect the respective system from the supply, respectively.

The removed and separated plug-in module may then be examined remote from the electric system by means of special testing devices, and replaced or reassembled, as the case may be.

With respect to the state of the art, reference is made e.g. to DE 36 39 533 C2, DE 295 19 313 U1, DE 100 01 667 C1, and DE 20 2004 006 227 U1.

As a special problem attention should be paid to the fact that in the course of designing the male contact arrangement between lower part and plug-in module, this contact is to be designed for the surge current flowing through said contact in the discharge case with wave forms 10/350 μs and 8/20 μs or the mains frequency short circuit current, respectively.

In particular in overvoltage lightning current arresters as they are demanded in the market, partly considerable surge currents of up to 100 kA have to be carried several times via these contacts in such a manner that nearly no contact erosion or wear occurs. The relevant tests are specified in the product standards for overvoltage protection devices.

In order to reliably control surge currents of such magnitude, a very high contact force between the individual contact elements has to be selected. The consequence is that the plug-in modules according to the state of the art can be removed with considerable force applied and in most cases with the aid of a special tool only. Thus, an additional tool is required which means a considerable drawback for the use of the devices. There is also an additional potential hazard in that when handling the tool, an arcing fault may be caused unintentionally within the arrester with the resulting danger for humans and systems.

In cases where the contact force between the contact elements is designed lower, the removal of the plug-in modules may be facilitated, but there is a risk that under the influence of the effects of electrodynamic forces during the surge current, the plug-in module may unintentionally come free from the lower part so that a proper overall function of the device without providing for additional protective means is no longer ensured.

OBJECTS AND SUMMARY OF THE INVENTION

In view of the above it is therefore the object of the invention to provide an advanced plug-in combination of appliances for protection against overvoltages, comprising a socket-type lower part and one or several plug-in modules, with the combination of appliances being capable of carrying considerable surge currents in a manner with is free from erosion and wear, on the one hand, while the plug-in module which is located in the socket-type lower part enabling its disconnection and removal without any problems, i.e. without auxiliary means or special tools, on the other hand.

The object of the invention is solved by means of the combination of characteristics according to the teaching of Claim 1, with the dependent claims including at least useful embodiments and developments.

Thus, the basic idea of the invention is to separate the functions between the assemblies of the electric male contact system, a locking unit, and disengagement elements in such a manner that the plug-in module biases one or several mechanic energy stores, e.g. in the form of leaf or helical springs, upon the insertion into the socket-type lower part.

The locking unit locks the plug-in module in the desired end position.

If the plug-in module has to be removed, the locking at the locking unit is cancelled by simply applying a manual force. Due to the effect of the mechanical force, the plug-in module may then be moved out of the lower part, with negligible tensile forces applied.

The design of the above mentioned functional groups may be varied and thus optimised over a wide range. It is therefore principally conceivable to design the disengagement forces in such a manner that the plug-in module is automatically urged out of the male contacts. The mechanical adjustment may likewise be made in such a manner that the plug-in modules can be pulled out with considerable force only.

An essential advantage of the invention is that the contact system proper, i.e. the structural design of the contact elements and counter contact elements can optimally be designed for the function as a surge current discharge.

In the realisation of the inventive basic idea, a functionally separated arrangement of mechanical catch or snap-in elements is therefore provided which act between the respective plug-in module und the socket-type lower part, regardless of the forces which keep the contact elements and counter contact elements positively and/or non-positively connected with the plug-in module inserted.

The catch or snap-in function may be cancelled without any mechanical auxiliary means when a replacement or inspection of the respective plug-in module is desired.

Furthermore, a spring-type mechanical energy store is provided in an embodiment between the lower part and the plug-in module, which upon inserting the respective plug-in module is biased and upon cancelling the catch or snap-in function releases mechanical energy for disengaging the plug-in module from the socket-type lower part.

The plug-in module comprises a carrier unit with a bottom group, with several large-area contact elements being arranged at the bottom group.

The bottom group further includes a trough-type lower side from which stop edges, stop faces, and/or stop pins extend downwards in the direction of the socket-type lower part.

The carrier unit is enclosed in a hood, with the hood comprising a hinge face at opposite sides, which continues into a pressure plate at whose ends catch projections or catch cams are provided which in the inserted condition fulfil the catch or snap-in function with respect to the lower part.

The hood may be formed as a plastic mould part, wherein the hinge face may be a so-called foil hinge joint. The hinge face with the pressure plate is normally biased in such a manner that the catch projections or catch cams assume a maximally outer position. By subjecting the pressure plate to a small force, the catch projections or catch cams may be moved towards each other, i.e. in the direction of the hood inner side, and exit and clear complementary recesses which are located in the socket-type lower part.

The above mentioned carrier unit accommodates the overvoltage protection elements proper. A face or edge which limits the movement of the pressure plate is arranged below the pressure plate of the hood.

In the area of the bottom assembly of the carrier unit catch projections are provided which engage the complementary recesses in the hood, locking it.

The hood comprises two opposite wide sides and two opposite narrow sides, with the pressure plates being located at the narrow sides.

The recesses in the hood are preferably arranged in the lower portion of the wide sides.

For an easier actuation of the pressure plates and for pulling out the plug-in module from the lower part, the outer surface of the pressure plate is patterned.

The catch projections or catch cams of the pressure plate may comprise a wedge-shaped sliding surface with the respective wedge tips being oriented in the direction of insertion. During the insertion process, the wedge-shaped sliding surfaces slide along the surface of the socket-type lower part and then engage the recesses provided therein, with the pressure plate being relieved.

At the bottom group, coding pins and/or an element which triggers a telecommunication contact may be provided.

In an embodiment of the invention the hood has a wedge shape in its lower portion, which extends over the hood's width. In this embodiment, the hood is further spherically or arc-shaped at its upper portion.

The lower part of the combination of appliances has a U-shape, with catch or snap-in elements being arranged in the open legs of the lower part, and with recesses being provided in the connecting leg for the spring-type mechanical energy store(s) and their actuation.

The open legs may further comprise longitudinally extending guide rails for facilitating the insertion of the plug-in module. These guide rails may also have a coding function in order to enable a defined insertion, so that a wrong installation of the respective lower parts can be prevented.

The connecting leg of the lower part comprises a shape which is complementary to the lower side of the bottom group, with receptacles being provided for one spring unit each below the connecting leg, which provide an upward access for the stop edges, stop pins, or stop faces of the bottom group.

Preferably, the respective spring units bear against the bottom of the socket-type lower part. The springs of the spring unit are replaceable so that with a standardised structural concept of the lower part an adjustment to the respective application with respect to bias und disengagement forces can be easily effected.

At least one recess for a coding pin or an access to a telecommunication contact is provided in the connecting leg.

The catch or snap-in elements as well as the mechanical energy stores are multiple-provided and are preferably arranged symmetrically.

The connecting leg of the lower part comprises one integrally formed web each at both sides, which stabilises the opposite open leg portions, so that there is not risk that these portions are driven apart upon the insertion of the plug-in module.

The respective plug-in module with the hood upper part and the pressure plates located thereon protrudes in the inserted condition and thus remains accessible for the actuation of the pressure plates for the purpose of removing the plug-in module.

The contact elements and the counter contact elements which are located in the plug-in module, on the one hand, and in the lower part, on the other hand, are made as male contacts which are capable of carrying surge currents and which have a high contact holding force, with the contact holding force, however, being not required to primarily or simultaneously provide a mechanical locking of the plug-in module in the lower part.

BRIEF DESCRIPTION OF THE DRAWINGS

In the following, the invention will be described in more detail with reference to an embodiment and to the figures in which.

DETAILED DESCRIPTION OF THE PREFERRED EMBODIMENTS

Figure 1:
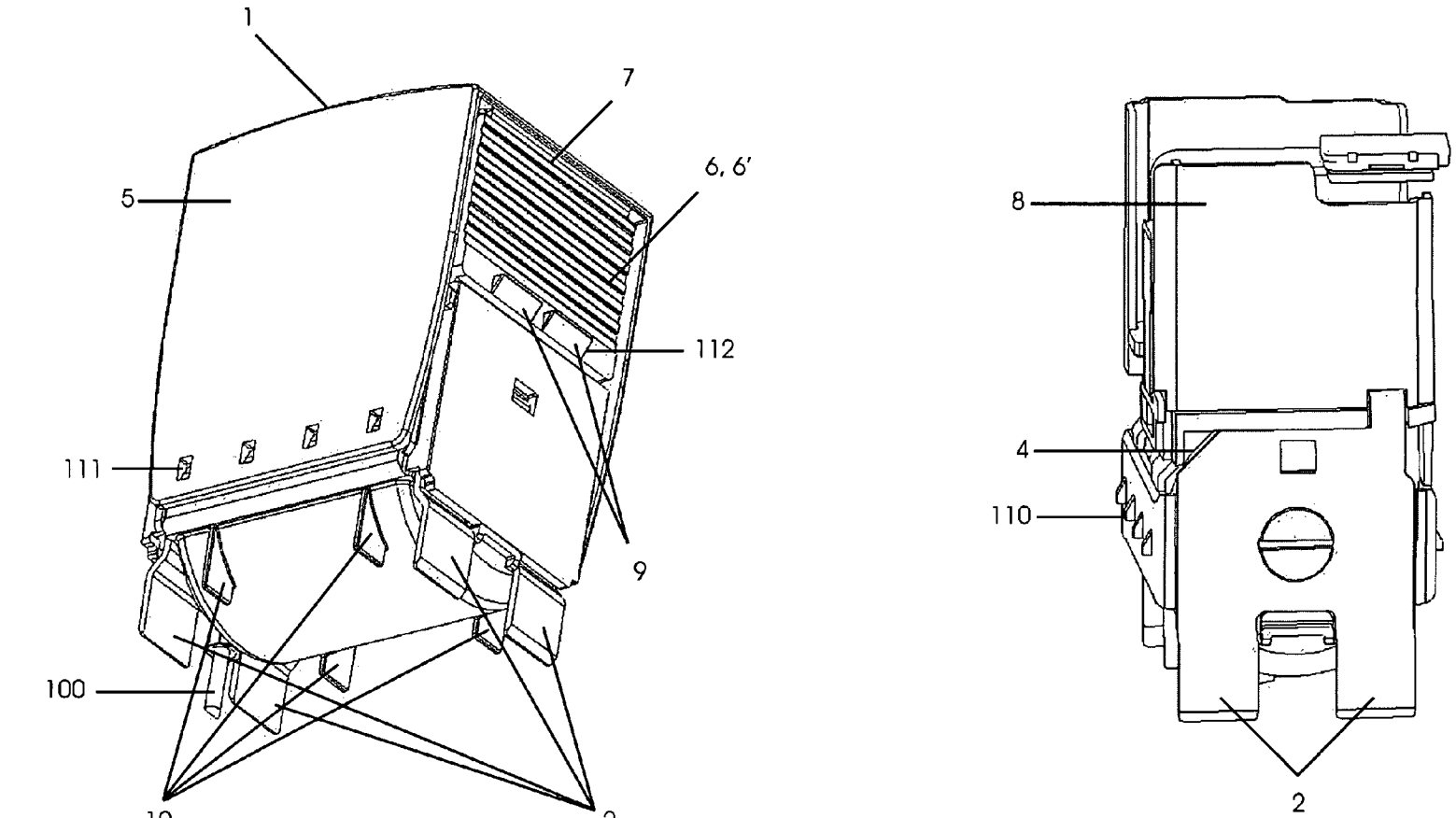
FIG. 1 is a three-dimensional illustration of an inventive plug-in module with the hood installed (left side of the figure) as well as a view of the carrier unit without hood (right side of the figure)

As can be seen from FIG. 1, the plug-in module 1 consists of a carrier unit 4 and a hood 5.

Below the hood 5 or on the carrier unit 4, respectively, the active components proper of the overvoltage discharge device are arranged and in electric contact with the male contacts 2.

The male contacts 2 are made as large-area metallic blocks which are preferably arranged symmetrically at the opposite sides.

On both end faces of the hood 5, actuating faces 6' made as pressure plates 6 are arranged.

These can be integrated into the construction of the hood element at reasonable costs because they are movably arranged at the top via a mechanically configured hinge face 7.

When subjecting the actuating faces 6' to a mechanical force, they are moved inwardly, with a stop plate 8 of the carrier unit 4 serving as a displacement limiter.

The available displacement of the pressure plate 6 is so adjusted that the catch projections 9 arranged in the lower part exit their mating pieces 9' (see FIG. 2) so that the locking engagement is cancelled.

In the illustrated embodiment, a total of two catch projections 9 each are arranged at the end faces so that the plug-in module 1 comprises a total of four fixed points and is thereby correctly balanced and maintained free of distortion in the desired position.

The surface of the actuating face 6' is provided with a pattern so that the removal of the plug-in module 1 is easy without requiring an excessive effort.

The lower side of the carrier unit 4 which is formed as a trough-type bottom group may additionally comprise a coding pin or a telecommunication actuating contact 100.

Figure 2:
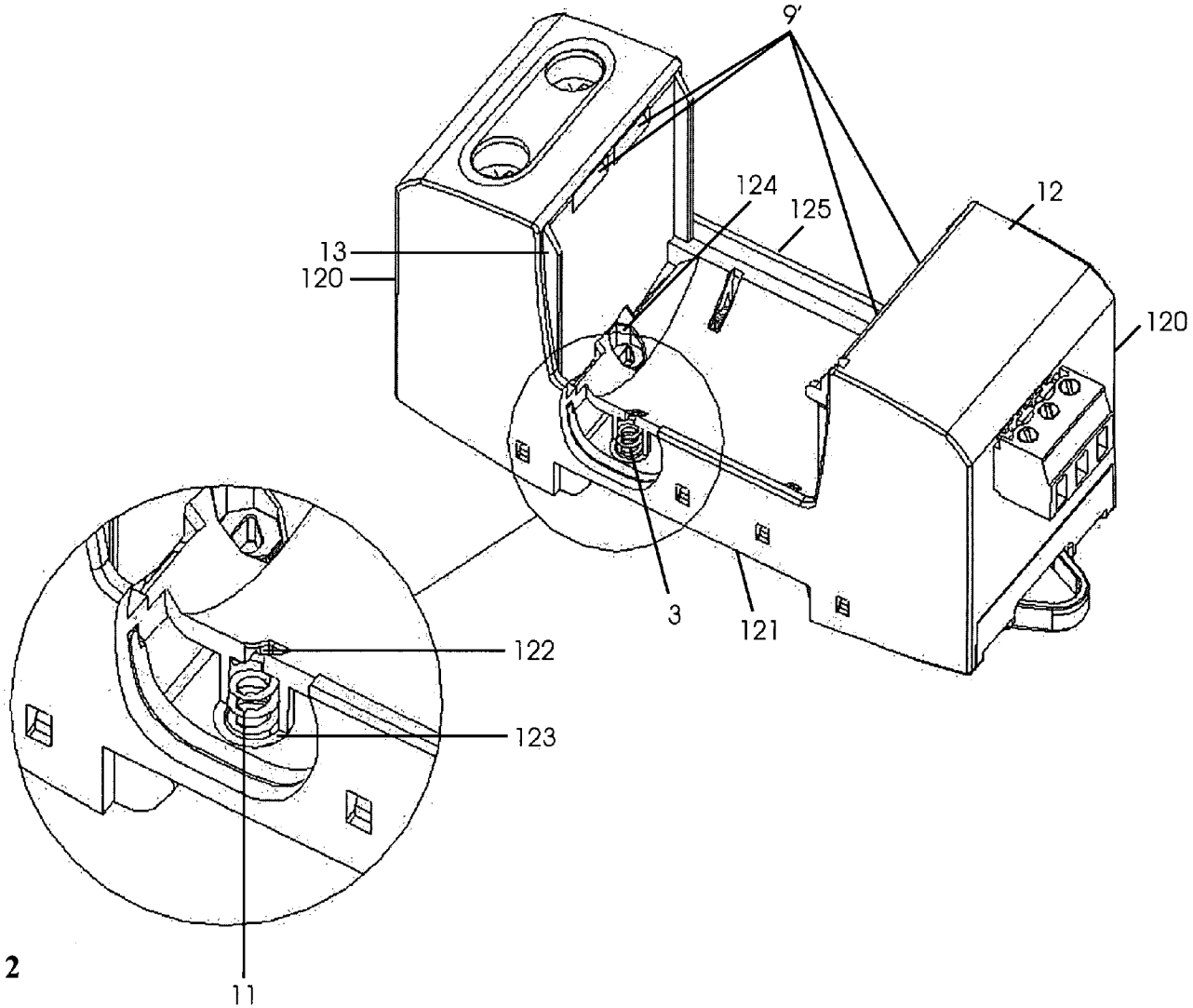
FIG. 2 shows an illustration of the U-shaped lower part with a detail of the spring unit.

Stop edges, stop faces, or stop pins 10 extend from the lower side of the above mentioned bottom group, which act as pressure points with respect to said associated spring unit 11 (FIG. 2).

The carrier unit 4 comprises catch projections 110 in the area of the bottom group, which engage complementary recesses 111 in the hood 5 locking it.

The catch projections 9 of the pressure plate 6 have a wedge-shaped sliding surface 112, with the wedge tips being oriented in the direction of insertion.

As can be seen from the illustration, the hood 5 is designed wedge-shaped in its lower portion, with the top of the hood 5 having a spherical or arc-shaped configuration.

Each plug-in module 1 is preferably provided with two or four symmetrically arranged male contact elements 2. By forming the male contact elements 2 as a movable or stationary part, respectively, it is possible to carry relatively high surge currents in a nearly wear-free manner via the large-area contact elements. The uniformly distributed arrangement of individual male contacts at the lower side ensures a uniform homogeneous force distribution so that even with high electrodynamic forces, no deformation or tilt of the plug-in module within the lower part will occur.

Figure 3:
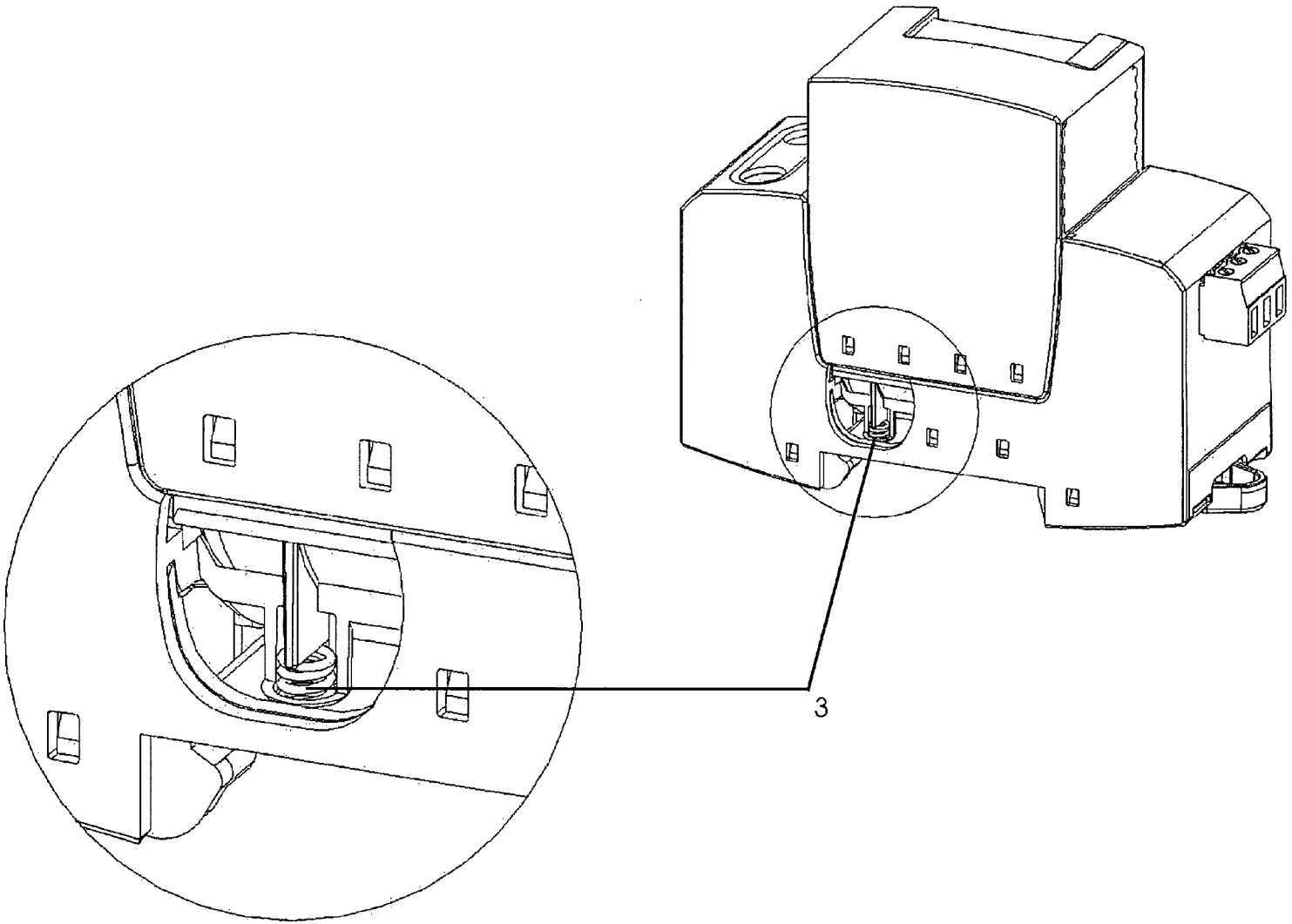
FIG. 3 is an illustration of the complete plug-in combination of appliances with the plug-in module inserted and a detail of the mechanical energy storage with the plug-in module fully inserted into the socket part.

According to the illustration in FIGS. 2 and 3, the lower part of the combination of appliances has a U-shape. The lower part 12 comprises two open U-shaped legs 120 and a connecting leg 121.

The above mentioned recesses 9' for the catch projections 9 of the plug-in module 1 are formed in the open legs 120 of the lower part 12.

The connecting leg 121 comprises recesses 122 for the spring-type mechanical energy store(s) and their actuation.

In an embodiment of the invention, the open legs 120 are provided with guide rails 13 for an easier and correct insertion of the respective plug-in module 1.

The connecting leg 121 further comprises at its top a shape which is complementary to the lower side of the bottom group of the plug-in module 1, with receptacles 123 being provided for one spring unit 11 each below the connecting leg, which comprise an upward access for the stop edges 10 of the bottom group of the plug-in module 1.

As can be seen from FIGS. 2 and 3, the respective spring units 1 each of which comprises at least one helical spring, bear against the bottom of the socket-type lower part.

In the connecting leg 121 there is also provided at least one recess 124 for a coding pin or as an access to a telecommunication contact.

At both sides of the connecting leg 121 an integrally formed web 125 is provided for reinforcing and stabilising the entire arrangement of the lower part.

In the inserted condition (see FIG. 3) the plug-in module 1 with the hood upper part and the pressure plates disposed thereon remains accessible.

During the insertion of the plug-in module 1 into the lower part 12, which is guided by the guide rails and making the desired electric contact between the respective male contact 2 and the counter pieces in the lower part, the mechanical force applied is utilised to bias the mechanical energy stores 3 and 11, respectively, which are disposed in the lower part 12.

This is effected by the respective stop edges, stop pins, or stop faces with the pressure points provided thereon.

In each lower part 12 there are preferably integrated e.g. four spring units 11. The number and the symmetrical positioning ensure an optimum homogeneity of the force application.

The disengagement force to be set and the associated disengagement travel may be varied over a wide range via the actual structural design of the mechanical energy store 3, in particular the selection of a suitable spring element and its spring characteristic.

Upon disengaging the catch projections 9 from the recesses 9' by subjecting the pressure plate 6 or the actuating face 6', respectively, to a compressive force, the catch projections 9 are disengaged from the recesses 9'. As a result, the plug-in module 1 may be removed easily under utilisation of the stored mechanical energy in the spring units without further mechanical auxiliary means or tools.

List of Reference Numerals

1 Plug-in module
2 Male contacts
3 Mechanical energy store
4 Carrier unit
5 Hood
6 Pressure plate
6' Actuation face
7 Hinge face
8 Stop face
9 Catch projections
9' Recesses for catch projection in the lower part
10 Stop edges or their pressure points
11 Spring unit
12 Lower part
13 Guide rails
100 Coding pin and/or telecommunication contact
110 Catch elements at the bottom group of the carrier unit
111 Recesses in the hood
112 Wedge-shaped sliding surfaces of catch projections
120 Open leg of lower part 12
121 Connecting leg of lower part
122 Recess as access to spring unit
123 Receptacle for spring unit
124 Recess for coding pin and/or telecommunication contact
125 Web

What is claimed is:

1. A plug-in combination of appliances for protection against overvoltages, comprising a socket-type lower part and at least one plug-in module, the plug-in module accommodating an overvoltage protection element and contact elements arranged in the plug-in module, the socket-type lower part accommodating counter contact elements arranged in the lower part, at least one of the plug-in module and the socket-type lower part having complementary guide rails or guide grooves for the controlled insertion or sliding-on and fixing of the plug-in module, characterized in that functionally separated mechanical catch or snap-in elements respectively providing a catch or snap-in function are provided, the mechanical catch or snap-in elements acting between the plug-in module and the socket-type lower part, regardless of the forces which keep the contact elements and counter contact elements positively or non-positively connected with the plug-in module when the plug-in module is inserted into the lower part, with the catch or snap-in function being cancelled without any mechanical auxiliary means when a replacement of the plug-in module is desired;

wherein the plug-in module comprises a carrier unit with a bottom group, with several large-area contact elements being arranged on the bottom group, the bottom group further comprising a trough-type lower side and stop edges, stop faces, or stop pins extending downwards from the trough-type lower side towards the socket-type lower part;

and wherein the carrier unit is enclosed by a hood, the hood having a hinge face at two opposite sides, the hinge face continuing into a pressure plate having an end and catch projections or catch cams provided at the end which fulfil the catch or snap-in function with respect to the lower part when the plug-in module is inserted into the lower part, and further a spring-type mechanical energy store is provided between the lower part and the plug-in module, wherein the spring-type mechanical energy store, upon insertion of the plug-in module into the socket-type lower part, is biased and upon cancelling the catch or snap-in function releases mechanical energy for removing the plug-in module from the socket-type lower part.

2. The plug-in combination of appliances according to claim 1, characterized in that the carrier unit accommodates the overvoltage protection elements, and wherein the carrier unit includes a face or edge formed below the pressure plate of the hood, the face or edge limiting the movement of the pressure plate.

3. The plug-in combination of appliances according to claim 1, characterized in that the catch projections are provided in the area of the bottom group of the carrier unit, wherein the catch projections engage complementary recesses in the hood thereby locking the hood to the carrier unit.

4. The plug-in combination of appliances according to claim 1, characterized in that the hood comprises two opposite wide sides and two opposite narrow sides.

5. The plug-in combination of appliances according to claim 4, characterized in that the pressure plate is provided at at least one of the narrow sides.

6. The plug-in combination of appliances according to claim 4, characterized in that each of the wide sides of the hood includes a lower portion, and the recesses in the hood are arranged in the lower portions of the wide sides.

7. The plug-in combination of appliances according to claim 1, characterized in that the pressure plate includes an outer surface, and the outer surface of the pressure plate is patterned.

8. The plug-in combination of appliances according to claim 1, characterized in that each of the catch projections or catch cams of the pressure plate has a wedge-shaped sliding surface and a wedge tip, with the respective wedge tips being oriented in a direction in which the plug-in module is inserted into the socket-type lower part.

9. The plug-in combination of appliances according to claim 1, characterized in that a coding pin or an element which triggers a telecommunication contact is provided at the bottom group.

10. The plug-in combination of appliances according to claim 1, characterized in that the hood includes a lower portion, the lower portion having a width, the lower portion of the hood having a wedge shape, the wedge shape extending over the width of the lower portion of the hood.

11. The plug-in combination of appliances according to claim 1, characterized in that the hood includes a top, the top of the hood being spherically or arc-shaped.

12. The plug-in combination of appliances according to claim 1, characterized in that the lower part has a U-shape and includes open legs and a connecting leg situated between the open legs, with the catch or snap-in elements being arranged in the open legs of the lower part, and with recesses being provided in the connecting leg for actuation of the spring-type mechanical energy store.

13. The plug-in combination of appliances according to claim 12, characterized in that the open legs comprise longitudinally extending guide rails to facilitate the insertion of the respective plug-in module.

14. The plug-in combination of appliances according to claim 1, characterized in that the lower part has a U-shape and includes open legs and a connecting leg situated between the open legs, and the connecting leg comprises a shape which is complementary to the lower side of the bottom group, the connecting leg further including spring units, with receptacles being provided for one spring unit each below the connecting leg, the receptacles providing an upward access for the stop edges, stop pins, or stop faces of the bottom group.

15. The plug-in combination of appliances according to claim 14, characterized in that the socket-type lower part includes a bottom, and the respective spring units bear against the bottom of the socket-type lower part.

16. The plug-in combination of appliances according to claim 12, characterized in that at least one recess for a coding pin or an access to a telecommunication contact is provided in the connecting leg.

17. The plug-in combination of appliances according to claim 1, characterized in that the catch or snap-in elements as well as the mechanical energy stores are multiple-provided and are preferably arranged symmetrically.

18. The plug-in combination of appliances according to claim 12, characterized in that the connecting leg includes opposite axial sides and a web extending between the opposite axial sides, the web stabilizing the open legs.

19. The plug-in combination of appliances according to claim 1, characterized in that the hood includes an upper portion, the pressure plates being disposed on the upper portion of the hood, and wherein the plug-in module with the upper portion of the hood and the pressure plates disposed thereon remains freely accessible when the plug-in module is inserted into the socket-type lower part.

* * * * *